US005292428A

United States Patent [19]

Harrison et al.

[11] Patent Number: 5,292,428

[45] Date of Patent: Mar. 8, 1994

[54] MULTI-STEP HYDRODESULPHURIZATION PROCESS

[75] Inventors: George E. Harrison, Billericay; Donald H. McKinley, Radlett; Alan J. Dennis, Middlesbrough, all of United Kingdom

[73] Assignee: Davy McKee (London) Ltd., London, United Kingdom

[21] Appl. No.: 781,173

[22] PCT Filed: May 9, 1990

[86] PCT No.: PCT/GB90/00718

§ 371 Date: Dec. 11, 1991

§ 102(e) Date: Dec. 11, 1991

[87] PCT Pub. No.: WO90/13617

PCT Pub. Date: Nov. 15, 1990

[30] Foreign Application Priority Data

May 10, 1989 [GB] United Kingdom ..... 8910711

[51] Int. Cl.[5] ..... C10G 45/00; C10G 45/04

[52] U.S. Cl. ..... 208/208 R; 208/209; 208/210; 208/213

[58] Field of Search ..... 208/208 R, 209, 210, 208/213

[56] References Cited

U.S. PATENT DOCUMENTS

| | | | |
|---|---|---|---|
| 3,809,644 | 5/1974 | Johnson | 208/210 |
| 3,847,799 | 11/1974 | Munro | 208/210 |
| 4,243,519 | 1/1981 | Schorfheide | 208/210 |

FOREIGN PATENT DOCUMENTS

| | | |
|---|---|---|
| 1191220 | 5/1970 | United Kingdom . |
| 1437527 | 10/1973 | United Kingdom . |
| 1560599 | 2/1980 | United Kingdom . |

OTHER PUBLICATIONS

Unzelman, G. H., "Higher Diesel Quality Would Constrict Refining", *Oil & Gas Journal, Technology,* Jun. 29, 1987, pp. 55–59.

Stormont, D. H., "Here's A Nomenclature-System Proposal for Hydroprocessing", *The Oil and Gas Journal,* Oct. 7, 1968, pp. 174 & 176.

"Refiners Seek Improved Hydrogen Production", *Oil & Gas Journal, Technology* Jul. 20, 1987, pp. 48–49.

(List continued on next page.)

*Primary Examiner*—Theodore Morris
*Assistant Examiner*—Zeinab El-Arini
*Attorney, Agent, or Firm*—Rothwell, Figg, Ernst & Kurz

[57] ABSTRACT

Liquid sulphur-containing hydrocarbon feedstock is passed through two or more hydrodesulfurization zones and connected in a series each containing a packed bed of solid sulfurized catalyst. The liquid is passed from the first zone to the next until the final zone. Make up hydrogen is supplied to a hydrodesulfurization zone (i) other than the first hydrodesulfurization zone; hydrogen-containing gas is recovered from each hydrodesulfurization zone. The first hydrodesulfurization zone is supplied with hydrogen-containing gas recovered from a subsequent hydrodesulfurization zone. Hydrogen-containing gas recovered from the first hydrodesulfurization zone is purged. Liquid material recovered from the first hydrodesulfurization zone is recycled to the inlet of the hydrosulfurization zone so as to provide diluent for admixture with liquid feedstock. Any other hydrodesulfurization zone other than the first hydrodesulfurization zone and other than the hydrodesulfurization zone of step (i) is supplied with hydrogen-containing gas recovered from another hydrodesulfurization zone. The sulfur content of the hydrogen-containing gas and of the liquid hydrocarbon feedstock supplied to the first hydrodesulfurization zone is monitored and, if necessary, sulfur-containing material selected from hydrogen sulfide and active sulfur-containing materials is supplied to the first hydrodesulfurization zone so as to maintain the catalyst charge thereof in sulfided form.

14 Claims, 4 Drawing Sheets

OTHER PUBLICATIONS

Satterfield, C. N., et al., "Kinetics of Thiophene Hydrogenolysis on a Cobalt Molybdate Catalyst", *Aiche Journal,* vol. 14, No. 1, Jan. 1968, pp. 159–164.

Sapre, A. V., et al., "Hydrogenation of Aromatic Hydrocarbons Catalyzed by Sulfided CoO-$MoO_3$/-$\gamma$-$Al_2O_3$. Reactivities and Reaction Networks", *Ind. Eng. Chem. Process. Des. Dev.,* vol. 20, No. 1, 1981, pp. 68–73.

Sapre, A. V., et al., "Hydrogenation of Biphenyl Catalyzed by Sulfided CoO)-$MoO)_3/\gamma$-$Al_2O_3$. The Reaction Kinetics", *Ind. Eng. Chem. Process. Des. Dev.,* vol. 21, No. 1, 1982, pp. 86–94.

Broderick, D. H., et al., "Hydrogenolysis and Hydrogenation of Dibenzothiophene Catalyzed by Sulfided Co0-$MoO_3/\gamma$-$Al_2O_3$: The Reaction Kinetics", *Aiche Journal*, vol. 27, No. 4, Jul. 1981, pp. 663–672.

Broderick, D. H., et al., "Hydrogenation of Aromatic Compounds Catalyzed by Sulfided CoO)-$MoO)_3$. /$\gamma$-$Al_2O_3$", *Journal of Catalysis,* vol. 73, 1982, pp. 45–49.

Moyes, R. B., *Hydrogenation Effects of Catalysis,* Marcel Dekker, Inc., 1988, pp. 548–607.

*Hydrocarbon Processing,* Sep. 1984, pp. 70–94.

"Hydrocarbon Processing 1988 Refining Handbook", *Hydrocarbon Processing, Sep. 1988, pp. 61–91.*

"New Shell Hydrodesulfurization Process Shows These Features", *Petroleum Refiner,* vol. 32, No. 5, May 1953, pp. 137–140.

"Panel Gives Hydrotreating Guides", *Hydrocarbon Processing,* Mar. 1989, pp. 113–116.

International Search Report corresponding to the present application, Jul. 1990.

MULTI-STEP HYDRODESULPHURIZATION PROCESS

FIELD OF THE INVENTION

This invention relates to a process for hydrodesulphurisation of a hydrocarbon feedstock.

DESCRIPTION OF BACKGROUND ART

Crude oils, their straight-run and cracked fractions and other petroleum products contain sulphur in varying amounts, depending upon the source of the crude oil and any subsequent treatment that it may have undergone. Besides elemental sulphur, numerous sulphur compounds have been identified in crude oil including hydrogen sulphide ($H_2S$), $C_1$ to $C_5$ primary alkyl mercaptans, $C_3$ to $C_8$ secondary alkyl mercaptans, $C_4$ to $C_6$ tertiary alkyl mercaptans, cyclic mercaptans (such as cyclopentane thiol, cyclohexane thiol and cis-2-methylcyclopentane thiol), open chain sulphides of the formula R—S—R′ where R and R′ represent $C_1$ to $C_4$ alkyl groups, mono-, bi- and tri-cyclic sulphides, thiophene, alkyl substituted thiophenes, condensed thiophenes (such as benzo(b)thiophene, isothionaphthene, dibenzothiophene, and benzo(b)naphtho(2,1-d)thiophene), thienothiophenes, alkyl cycloalkyl sulphides, alkyl aryl sulphides, 1-thiaindans, aromatic thiols (such as thiophenol), and cyclic thiols such as cyclohexane thiol.

Generally speaking, low API gravity crude oils usually contain more sulphur than high API gravity crude oils, although there are some exceptions. Moreover the distribution of sulphur compounds in the different fractions of petroleum varies mainly with the boiling range of the fractions. Thus the lighter fractions such as naphtha contain fewer sulphur compounds, whilst the content of sulphur compounds also increases as the boiling point or API density or molecular weight of the fraction increases. Most of the sulphur compounds that have been positively identified as components of crude oil boil below about 200° C. Many other sulphur compounds of high molecular weight and high boiling point remain unidentified in crude oil.

For a variety of reasons it is necessary to treat crude oil and petroleum fractions derived therefrom to remove the sulphur components present therein. Otherwise subsequent processing may be hindered, for example because the sulphur components may adversely affect the performance of a catalyst. If the hydrocarbon fraction is intended for fuel use, then burning of the fuel will result in any sulphur components present therein being converted to sulphur oxides which are environmentally damaging.

For these reasons it is necessary to remove as far as possible the sulphur content from hydrocarbon fractions derived from crude oil, such as gasoline fractions, diesel fuel, gas oils and the like. Typically such sulphur removal is carried out by a process known generally as hydrodesulphurisation. In such a process the hydrocarbon fraction is admixed with hydrogen and passed over a hydrodesulphurisation catalyst under appropriate temperature and pressure conditions. In such a process the aim is to rupture the carbon-sulphur bonds present in the feedstock and to saturate with hydrogen the resulting free valencies or olefinic double bonds formed in such a cleavage step. In this process the aim is to convert as much as possible of the organic sulphur content to hydrocarbons and to $H_2S$. Typical equations for major types of sulphur compounds to be hydrodesulphurised are shown below:

1. Thiols: $RSH + H_2 \longrightarrow RH + H_2S$

2. Disulphides: $RSSR' + 3H_2 \longrightarrow RH + R'H + 2H_2S$

3. Sulphides:

a. Open chain $$R{-}S{-}R' + 2H_2 \longrightarrow RH + R'H + H_2S$$

b. Cyclic

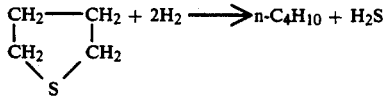

c. Bicyclic:

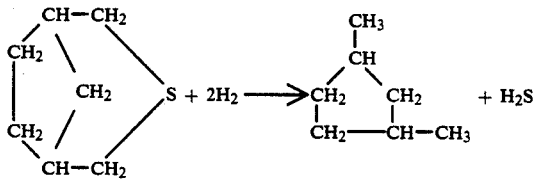

4. Thiophenes:

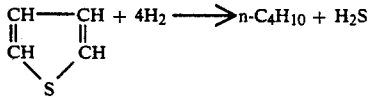

5. Benzothiophenes:

-continued

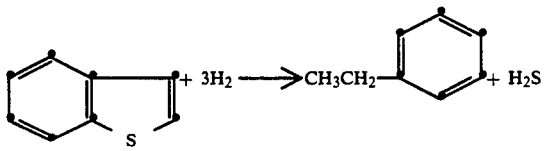

6. Dibenzothiophenes:

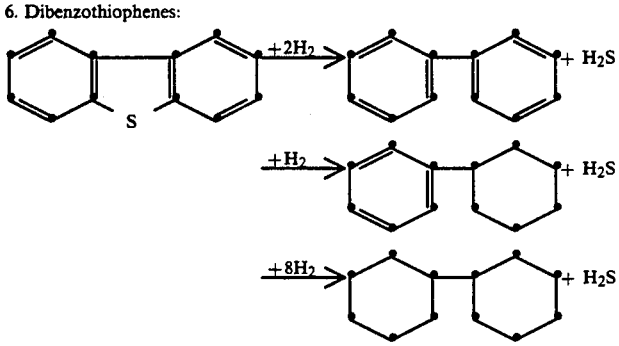

Generally the cyclic sulphur-containing compounds are harder to hydrogenate than the open chain compounds and, within the class of cyclic sulphur-containing compounds, the greater the number of rings that are present the greater is the difficulty in cleaving the carbon-sulphur bonds.

Besides the presence of sulphur oxides in the combustion gases from hydrocarbon fuels, other environmentally undesirable components of such combustion gases typically include aromatic hydrocarbons, which may be present because of incomplete combustion, and carbonaceous particulate matter often containing polycyclic aromatic hydrocarbons, metal compounds, oxygenated organic materials, and other potentially toxic materials.

Because of present concerns about pollution, increasingly stringent limits are being placed by various national legislations around the world upon the levels of permitted impurities in hydrocarbon fuels, such as diesel fuel. In particular the United States Environmental Protection Agency has recently proposed rules which would limit the sulphur content to 0.05 wt % and the aromatics content to 20 volume % in highway diesel fuels (see, for example, the article "Higher Diesel Quality Would Constrict Refining" by George H. Unzelman, Oil and Gas Journal, Jun. 19, 1987, pages 55 to 59). Such rules require refiners to face additional diesel treating requirements and increased investment and operating costs. Additional reductions in the permitted levels of sulphur content and aromatics content at some future date cannot be ruled out.

When a hydrocarbon feedstock is treated with hydrogen in the presence of a suitable catalyst with the aim of effecting hydrodesulphurisation, other reactions may also occur. Hence hydrotreating is often used as a more general term to embrace not only the hydrodesulphurisation reactions but also the other reactions that occur, including hydrocracking, hydrogenation and other hydrogenolysis reactions. The term "hydrotreating" is further explained in an article "Here is a nomenclature-system proposed for hydroprocessing", The Oil and Gas Journal, Oct. 7, 1968, pages 174 to 175.

There are four main hydrogenolysis reactions, of which hydrodesulphurisation (HDS) is probably the most important, followed by hydrodenitrogenation (HDN), hydrodeoxygenation (HDO), and hydrodemetallation (HDM). Amongst catalysts which have been proposed for such hydrotreating reactions are molybdenum disulphide, tungsten sulphide, sulphided nickel-molybdate catalysts ($NiMoS_x$), and cobalt-molybdenum alumina sulphide (Co-Mo/alumina).

Although the prior art regards the simultaneous occurrence of some hydrogenation reactions, such as hydrogenation of olefins and aromatic hydrocarbons, as not being advantageous in a hydrodesulphurisation process because the aromatic content of the product was within the required specification and because the use of valuable hydrogen for unnecessary hydrogenation reactions was deemed disadvantageous, there is a growing shortage of light crude oil. Thus the present and future trend towards the use of middle distillates and heavier petroleum fractions, coupled with increasingly stringent specifications, means that aromatic hydrogenation will be an increasingly necessary component of refinery operations. Hence, under current conditions and increasingly for the future, it will be desirable to combine hydrodesulphurisation and aromatic hydrogenation.

In contrast, except when processing high molecular weight residues, extensive hydrocracking reactions are to be avoided in most refinery hydrotreating operations as far as possible because they are highly exothermic and can cause thermal damage to catalysts and reaction vessels, as well as leading to the deposition of carbonaceous materials causing loss of catalyst activity. Thus an operator of a hydrodesulphurisation plant has reported in an article "Refiners seek improved hydrogen production", Oil & Gas Journal, Jul. 20, 1987, pages 48 and 49, that reactors in service have overheated severely, one to the point of rupture, due to unwanted hydrocracking reactions occurring.

The danger of such hydrocracking reactions occurring can be minimised by ensuring that the catalyst remains adequately sulphided.

A number of papers have appeared in the literature relating to hydrodesulphurisation technology, including:

(a) "Kinetics of Thiophene Hydrogenolysis on a Cobalt Molybdate Catalyst", by Charles N. Satterfield et al, AIChE Journal, Vol. 14, No. 1 (January 1968), pages 159 to 164;

(b) "Hydrogenation of Aromatic Hydrocarbons Catalysed by Sulfided $CoO-MoO_3$/gamma-$Al_2O_3$. Reactivities and Reaction Networks" by Ajit V. Sapre et al, Ind. Eng. Chem. Process Des. Dev, Vol. 20, No. 1, 1981, pages 68 to 73;

(c) "Hydrogenation of Biphenyl Catalyzed by Sulfided $CoO-MoO_3$/gamma-$Al_2O_3$. The Reaction Kinetics", by Ajit V. Sapre et al, Ind. Eng. Chem. Process Des Dev, Vol. 21, No. 1, 1982, pages 86 to 94;

(d) "Hydrogenolysis and Hydrogenation of Dibenzothiophene Catalyzed by Sulfided $CoO-MoO_3$/gamma-$Al_2O_3$: The Reaction Kinetics" by D. H. Broderick et al, AIChE Journal, Vol. 27, No. 4, July 1981, pages 663 to 672; and (e) "Hydrogenation of Aromatic Compounds Catalyzed by Sulfided $CoO-MoO_3$/gamma-$Al_2O_3$" by D. H. Broderick et al, Journal of Catalysis, Vol. 73, 1982, pages 45 to 49.

A review of the reactivity of hydrogen in sulphide catalysts, such as those used as hydrotreating catalysts, appears on pages 584 to 607 of the book "Hydrogen Effects of Catalysis" by Richard B. Moyes, published by Marcel Dekker, Inc. (1988).

A review of industrially practised hydrotreating processes is published each year in the Journal "Hydrocarbon Processing", normally in the September issue. For example reference may be made to "Hydrocarbon Processing", September 1984, page 70 et seq and to "Hydrocarbon Processing", September 1988, pages 61 to 91.

An outline of three prior art hydrotreating processes appears in "Hydrocarbon Processing 1988 Refining Handbook" on pages 78 and 79 of "Hydrocarbon Processing", September 1988. In the "Chevron RDS/VRDS Hydrotreating Process" a mixture of fresh liquid hydrocarbon feedstock, make-up hydrogen and recycled hydrogen is fed to a reactor in a "once-through" operation. As illustrated the reactor has three beds and inter-bed cooling is provided by injection of further amounts of recycle hydrogen. The recycle hydrogen is passed through an $H_2S$ scrubber. In the "HYVAHL Process" a once-through operation for the liquid feed is also used. Again, amine scrubbing is used to remove $H_2S$ from the recycle hydrogen. The Unionfining Process also utilises a once-through basis for the liquid feed. Co-current hydrogen and liquid flow is envisaged. Unreacted hydrogen is recycled.

In all three processes gas recycle is used to cool the catalyst bed and so minimise the risk of thermal runaways occurring as a result of significant amounts of hydrocracking taking place. Use of gas recycle means that inert gases tend to accumulate in the circulating gas which in turn means that, in order to maintain the desired hydrogen partial pressure, the overall operating pressure must be raised to accommodate the circulating inert gases and that the size and cost of the gas recycle compressor must be increased and increased operating costs must be tolerated.

Use of a trickle technique is described in an article "New Shell Hydrodesulphurisation Process Shows These Features", Petroleum Refiner, Vol. 32, No. 5 (May 1953), page 137 et seq. FIG. 1 of this article illustrates a reactor with four catalyst beds with introduction of a mixture of hot gas and gas oil at the inlet end of the first bed and use of cold shots of gas oil between subsequent beds.

In these hydrodesulphurisation processes the conditions at the inlet end of the catalyst bed are critically important because this is where the risk of hydrocracking is greatest, especially if the level of sulphurisation of the catalyst should drop. This can occur, for example, if a low sulphur feedstock is fed to the plant or if a feedstock is used in which the sulphurous impurities are predominantly polycyclic compounds.

Hydrorefining of a naphtha feedstock is described in U.S. Pat. No. 4,243,519. This appears to involve a substantially wholly vapour phase process.

Multiple stage hydrodesulphurisation of residuum with movement of catalyst between stages in the opposite direction to movement of gas and liquid is described in U.S. Pat. No. 3,809,644.

U.S. Pat. No. 3,847,799 describes conversion of black oil to low-sulphur fuel oil in two reactors. Make-up hydrogen is supplied to the second reactor but in admixture with hydrogen exiting the first reactor that has been purified by removal of hydrogen sulphide therefrom. Hence hydrogen is recovered from the first reactor and recycled to the second reactor in admixture with inert gases which will accordingly tend to accumulate in the gas recycle loop. Any condensate obtained from the first reactor is admixed with product from the second reactor.

In a hydrodesulphurisation plant with a gas recycle regime some of the $H_2S$ produced, normally a minor part thereof, will remain in the liquid phase after product separation whilst the remainder, normally a major part thereof, of the $H_2S$ will remain in the gas phase. Even in plants in which interbed cooling with "cold shots" of recycle gas is practised the $H_2S$ released remains in the gas/liquid mixture as this passes through the catalyst bed. Hence the $H_2S$ partial pressure is usually highest at the exit end of the catalyst bed or of the final bed, if more than one bed is used. As the catalyst activity for hydrodesulphurisation is decreased by raising the $H_2S$ partial pressure, the catalyst activity is lowest at the exit end from the bed which is where the highest activity is really needed if the least tractable polycyclic organic sulphurous compounds are to undergo hydrodesulphurisation.

The catalysts used for hydrodesulphurisation are usually also capable of effecting hydrogenation of aromatic compounds, provided that the sulphur level is low. The conditions required for carrying out hydrogenation of aromatic compounds are generally similar to those required for hydrodesulphurisation. However, as the reaction is an equilibrium that is not favoured by use of high temperatures, the conditions required for hydrodesulphurisation of cyclic and polycyclic organic sulphur compounds in a conventional plant do not favour hydrogenation of aromatic compounds. Moreover as the design of conventional hydrodesulphurisation plants results in high partial pressures of $H_2S$ at the downstream end of the plant the catalyst activity is correspondingly reduced and the conditions do not lead to significant reduction in the aromatic content of the feedstock being treated. Hence in an article entitled "Panel gives hydrotreating guides", Hydrocarbon Processing, March 1989, pages 113 to 116, it is stated at page 114:

> "It is a fundamental kinetic fact that at pressures for normal middle distillate desulfurizers (500 to 800 psig) it is difficult to obtain appreciable aromatic saturation. Thus, if the feedstock is far above the 20% aromatics level, there is not much you can do with typical hydrotreaters, with any catalysts that we have knowledge of, to significantly reduce aromatics.

You are then left with the unpalatable alternatives of higher pressure units, aromatic extraction, and all the other alternatives."

Removal of $H_2S$ from a hydrodesulphurisation plant with a gas recycle system is normally effected by scrubbing the recycle gas with an amine. As the scrubber section has to be sufficiently large to cope with the highest levels of sulphurous impurities likely to be present in the feedstocks to be treated, the scrubber equipment has to be designed with an appropriate capacity, even though the plant will often be operated with low sulphur feedstocks. The capital cost of such scrubber equipment is significant.

It would be desirable to provide a more efficient process for effecting hydrodesulphurisation of liquid hydrocarbon feedstocks, in particular one in which the danger of hydrocracking reactions occurring is substantially obviated. It would further be desirable to provide a hydrodesulphurisation process in which the activity of the catalyst is controlled throughout the reactor in such a way that improved levels of hydrodesulphurisation can be achieved at a given operating pressure than can be achieved in a conventional process. It would also be desirable to provide a hydrodesulphurisation process which permits operation in such a way as to achieve a simultaneous significant reduction in the aromatics content of the feedstock being treated, particularly those feedstocks in which the aromatics content exceeds about 20%.

SUMMARY OF THE INVENTION

The invention accordingly seeks to provide a process in which hydrodesulphurisation can be conducted more efficiently than in a conventional hydrodesulphurisation process. It also seeks to provide a hydrodesulphurisation process in which the activity of the catalyst is controlled favourably throughout the reactor to enable improved levels of hydrodesulphurisation of the feedstock to be achieved. It further seeks to provide a hydrodesulphurisation process which enables also a significant reduction in the aromatics content of the feedstock to be effected simultaneously with hydrodesulphurisation.

DETAILED DESCRIPTION OF PREFERRED EMBODIMENTS

Figure 1:
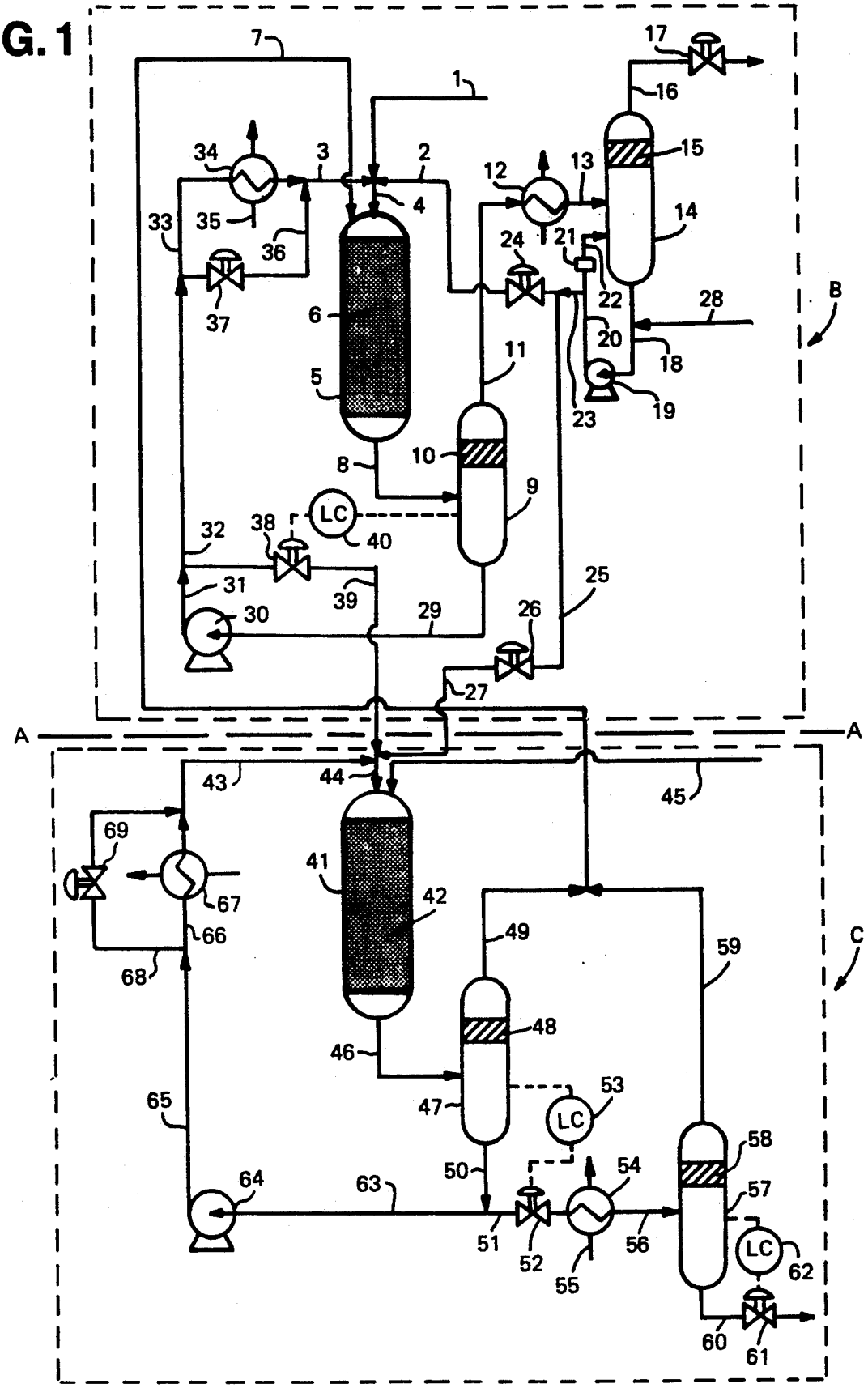
FIG. 1 is a flow diagram of a two stage hydrodesulphurisation plant designed to operate according to the process of the present invention.

According to the present invention there is provided a hydrodesulphurisation process for continuously effecting hydrodesulphurisation of a liquid sulphur-containing hydrocarbon feedstock which comprises:

(a) providing a plurality of hydrodesulphurisation zones connected in series each containing a packed bed of a solid sulphided hydrodesulphurisation catalyst, said plurality of hydrodesulphurisation zones including a first hydrodesulphurisation zone and at least one other hydrodesulphurisation zone including a final hydrodesulphurisation zone;

(b) maintaining temperature and pressure conditions in each hydrodesulphurisation zone effective for hydrodesulphurisation of the liquid feedstock;

(c) supplying liquid sulphur-containing hydrocarbon feedstock to the first hydrodesulphurisation zone;

(d) passing the liquid feedstock through the plurality of hydrodesulphurisation zones in turn from the first hydrodesulphurisation zone to the final desulphurisation zone;

(e) passing hydrogen-containing gas through the hydrodesulphurisation zones from one zone to another; and (f) contacting the liquid feedstock with hydrogen under hydrodesulphurisation conditions in each hydrodesulphurisation zone in the presence of the respective charge of hydrodesulphurisation catalyst;

and which further comprises:

(i) supplying make up hydrogen to a hydrodesulphurisation zone other than the first hydrodesulphurisation zone;

(ii) recovering a hydrogen-containing gas from each hydrodesulphurisation zone;

(iii) supplying the first hydrodesulphurisation zone with hydrogen-containing gas recovered from a subsequent hydrodesulphurisation zone;

(iv) purging hydrogen-containing gas recovered from the first hydrodesulphurisation zone;

(v) supplying any other hydrodesulphurisation zone other than the first hydrodesulphurisation zone and other than the hydrodesulphurisation zone of step (i) with hydrogen-containing gas recovered from another hydrodesulphurisation zone;

(vi) monitoring the sulphur content of the hydrogen-containing gas and of the liquid hydrocarbon feedstock supplied to the first hydrodesulphurisation zone; and (vii) supplying, if necessary, sulphur-containing material selected from $H_2S$ and active sulphur-containing materials to the first hydrodesulphurisation zone so as to maintain the catalyst charge thereof in sulphided form.

By the term active sulphur-containing materials there is meant materials which very rapidly form $H_2S$ under hydrodesulphurisation conditions in the presence of a hydrodesulphurisation catalyst. Examples of such materials include, for example, $CS_2$, COS, alkyl mercaptans, dialkyl sulphides, and dialkyl disulphides.

The solid sulphided catalyst used in the process of the present invention is preferably selected from molybdenum disulphide, tungsten sulphide, cobalt sulphide, sulphided nickel/tungsten sulphide, cobalt/tungsten sulphide,sulphided nickel-molybdate catalysts ($NiMoS_x$), a sulphided $CoO-MoO_3$/gamma-$Al_2O_3$ catalyst, and mixtures thereof.

Typical hydrodesulphurisation conditions include use of a pressure in the range of from about 20 bar to about 150 bar and of a temperature in the range of from about 240° C. to about 400° C. Preferred conditions include use of a pressure of from about 25 bar to about 100 bar and of a temperature of from about 250° C. to about 370° C.

The liquid sulphur-containing hydrocarbon feedstock may comprise a mixture of saturated hydrocarbons, such as n-paraffins, iso-paraffins, and naphthenes, in varying proportions. It may further comprise one or more aromatic hydrocarbons in amounts of, for example, from about 1 volume % up to about 30 volume % or more. If the feedstock has a low content of aromatic hydrocarbons, then hydrodesulphurisation will be the predominant reaction occurring. However, if the feedstock has an appreciable content of aromatic hydrocarbons, then at least some hydrogenation of these to partially or wholly saturated hydrocarbons may also occur concurrently with hydrodesulphurisation. In this case the hydrogen consumption will be correspondingly increased. The extent of such hydrogenation of aromatic hydrocarbons will be influenced by the choice of reaction conditions and so the degree of dearomatisation of the feedstock that is achieved can be affected by the reaction conditions selected.

In the process of the invention the stoichiometric hydrogen demand may thus be a function not only of the sulphur content of the feedstock but also of the aromatics content thereof. The actual hydrogen consumption will be a function of the severity of the reaction conditions chosen, that is to say the operating temperature and pressure chosen. Thus, for example, by conditions of high severity there is meant use of a high operating pressure, a high operating temperature, or a combination of both. By and large the higher the temperature is to which the hydrocarbon feedstock is subjected during hydrodesulphurisation at a given partial pressure of hydrogen, the closer will be the extent of aromatics hydrogenation (or dearomatisation) to that corresponding to the theoretical equilibrium concentration achievable. Thus the amount of hydrogen consumed by the process of the invention does not depend solely upon the nature of the feedstock but also upon the severity of the reaction conditions used.

If the feedstock is, for example, a diesel fuel feedstock then the reaction conditions used in the process of the invention will typically be chosen to reduce the residual sulphur content to about 0.5 wt % S or less, e.g. about 0.3 wt % S or less, even down to about 0.05 wt % S or less and to reduce the aromatics content to about 27 volume % or lower, e.g. to about 20 volume % or less. If the desired product is a "technical grade"0 white oil, then the process conditions will be selected with a view to reducing the sulphur content to very low levels and the aromatics content as far as possible. Typically the aim will be to reduce the aromatics content sufficiently to provide a white oil which is a colourless, essentially non aromatic, mixture of paraffin and naphthenic oils which conform to the following specification:

| | |
|---|---|
| Saybolt colour | +20 |
| UV Absorbance limits | |
| Maximum absorbance per centimeter | |
| 280–289 mμ | 4.0 |
| 290–299 mμ | 3.3 |
| 300–329 mμ | 2.3 |
| 330–350 mμ | 0.8 |

If the desired end product is a medicinal grade white oil complying with the current requirements of the U.S. Department of Food and Drug Administration, then the aim is to produce a product with a maximum uv absorption per centimeter at 260–350 nm of 0.1, measured on a dimethylsulphoxide extract using the procedure laid down in the U.S. Pharmacopoeia. Other specifications require a sample to give at most a weak colouring in a hot acid test using sulphuric acid and to give no reaction in the sodium plumbite test. To meet these stringent requirements effectively all aromatic hydrocarbons present in the feedstock must be hydrogenated.

In the process of the invention there will be used an amount of hydrogen which is equivalent to at least the stoichiometric amount of hydrogen required to desulphurise the feedstock and to achieve the desired degree of dearomatisation. Normally it will be preferred to use at least about 1.05 times such stoichiometric amount of hydrogen. In addition allowance has to be made for hydrogen dissolved in the recovered treated feedstock.

In the process of the invention the rate of supply of make up hydrogen-containing gas typically corresponds to an $H_2$:feedstock molar feed ratio of from about 2:1 to about 20:1; preferably this ratio is from about 3:1 to about 7:1.

The hydrogen-containing gas may be obtained in known manner, for example by steam reforming or partial oxidation of a hydrocarbon feedstock, such as natural gas, followed by conventional steps such as the water gas shift reaction, $CO_2$ removal, and pressure swing adsorption.

The process of the invention can be carried out in a plant having two hydrodesulphurisation zones or in one having more than two such zones, for example, 3, 4, 5, or more.

Different hydrodesulphurisation conditions may be used in different zones. Thus, for example, the temperature in the first hydrodesulphurisation zone may be lower than in the second such zone, which in turn may be lower than the temperature in any third such zone, and so on.

It is also envisaged that, in a plant with m zones, where m is an integer of 3 or more, the temperature may be increased from zone to zone from zone 1 to zone n, where n is an integer of 2 or more, but then the temperature is reduced from zone to zone so that the inlet temperature to zone (n+1) is lower than for zone n, and so on to zone m. Thus it is possible to operate the process so that the temperature increases zone by zone from zone 1 to zone n, but then decreases from zone (n+1) to zone (n+2), and so on, to zone m. Under this regime, particularly when the gas exiting zone m is supplied to zone (m−1), and that from zone (m−1) is supplied to zone (m−2), and so on, the feedstock will encounter progressively hotter conditions under essentially the same pressure, and progressively lower inlet $H_2S$ partial pressures in passing through zones 1 to n. Since the inlet $H_2S$ partial pressure is lower in the second and in any subsequent zone up to zone n than in zone 1, the catalyst is effectively less sulphided and hence more active in this zone or these zones than in zone 1. In this way the efficiency of hydrodesulphurisation is enhanced, since the conditions in the later zone or zones are more favourable for reaction of the remaining sulphur-containing compounds, which will tend to be the least reactive compounds, such as polycyclic sulphur-containing compounds. In addition, by reducing the temperature in zones (n+1) to m and also enhancing the catalyst activity in these zones by reducing the inlet $H_2S$ partial pressure in these zones, the conditions are rendered more favourable for effecting hydrogenation of aromatic components of the feedstock, a reaction Which, although promoted by an increase in hydrogen partial pressure, is equilibrium limited at high temperatures.

In a preferred process according to the present invention the liquid hydrocarbon feedstock to be hydrodesulphurised in the first hydrodesulphurisation zone is supplied thereto in the form of a liquid mixture with a compatible diluent. In this way the risk of temperature runaway and hydrocracking occurring in the first hydrodesulphurisation zone is minimised. Conveniently the compatible diluent comprises liquid material recycled from the exit end of the zone. It is also possible to dilute the material supplied to the or each subsequent hydrodesulphurisation zone in a similar manner with a compatible diluent, such as liquid from the exit end of the respective zone. The final hydrodesulphurisation zone can be operated advantageously with a feed with little or no added liquid diluent, such as recycled liquid product.

If there are only two hydrodesulphurisation zones the make-up hydrogen-containing gas is supplied to the second hydrodesulphurisation zone, which is thus the final hydrodesulphurisation zone, and the off-gas therefrom is then supplied to the first hydrodesulphurisation zone. If there are three or more such zones then the make-up hydrogen-containing gas can be supplied to the second such zone or to a subsequent such zone. However, in this case it will normally be preferred to supply the make-up hydrogen-containing gas to the final zone and to feed the off-gas therefrom to the penultimate zone, and so on. In this way the overall direction of gas flow through the series of zones is opposite to the overall direction of flow of liquid through the zones, although the gas and liquid may flow in co-current through each individual zone. In addition this arrangement enables the inlet $H_2S$ partial pressure to decrease from zone to zone of the series, thus effectively allowing the liquid feedstock to encounter catalyst that, whilst still remaining adequately sulphided to obviate the danger of hydrocracking reactions, increases in activity from zone to zone.

As the hydrogen-containing gas supplied to the first hydrodesulphurisation zone comes from a subsequent hydrodesulphurisation zone it will normally contain a proportion of $H_2S$. Since it will normally be preferred to supply the make-up gas to the final hydrodesulphurisation zone and to cause the gas to flow last of all to the first zone, the concentration of $H_2S$ in the gas tends to be at its highest in the gas feed to the first hydrodesulphurisation zone. The level of organic sulphur-containing compounds is lowest in the liquid feed to the final hydrodesulphurisation zone but these compounds are the least reactive. Whilst a sufficient inlet $H_2S$ partial pressure to the final hydrodesulphurisation zone should be maintained in order to keep the catalyst in the final hydrodesulphurisation zone in a sufficiently sulphided form to obviate the danger of hydrocracking in this zone, the catalyst activity will tend to be highest in this zone so that the conditions in this zone are favourable not only for effecting hydrodesulphurisation but also for effecting hydrogenation of aromatic compounds. Hence, under suitable operating conditions, a significant reduction of the aromatic hydrocarbon content of the feedstock can be effected, while at the same time achieving efficient removal of the less readily removed sulphur-containing materials.

It is also envisaged that different catalysts can be used in different zones in the process of the invention. In this case a catalyst favouring hydrodesulphurisation, rather than hydrogenation of aromatic compounds, can be used in the first zone or the first few zones, whilst a catalyst that has greater activity for hydrogenation of aromatic compounds is used in the later zone or zones.

The process of the invention also requires that the sulphur contents of the gas and liquid feeds to the first hydrodesulphurisation zone are monitored to ensure that there is sufficient $H_2S$ present to maintain the catalyst in sulphided form. More often than not the feedstock will contain sufficient active sulphur-containing material or the hydrogen-containing gas fed thereto will contain sufficient $H_2S$, or both, to maintain the catalyst in sufficiently sulphided form. However if, for any reason, there should be a dangerously low level of $H_2S$ or active sulphur-containing material at the inlet end of the first zone, then a sufficient additional amount of $H_2S$ or of an active sulphur compound, such as $CS_2$, COS, an alkyl mercaptan, a dialkyl sulphide, or a dialkyl disulphide, is added to one of the feed streams to the first hydrodesulphurisation zone to restore a safe level of sulphur at the inlet to the first zone.

Normally it will suffice to provide at the inlet end to the first hydrodesulphurisation zone a sulphur concentration, in the form of $H_2S$ or of an active sulphur material, of at least about 1 ppm, and preferably at least about 5 ppm, up to about 1000 ppm. Typically the sulphur concentration may range from about 10 ppm upwards, e.g. from about 40 ppm up to about 100 ppm.

It is further preferred to monitor the sulphur concentration at the inlet end of at least one subsequent zone, and preferably at the inlet end of each subsequent zone, and to bleed into the feed to that zone, if necessary, sufficient additional active sulphur-containing material to maintain the sulphur concentration within the range of from about 1 ppm to about 1000 ppm, e.g. about 5 ppm to about 100 ppm.

The feedstock to be treated is typically supplied at a liquid hourly space velocity of from about 0.1 $hr^{-1}$ to about 7 $hr^{-1}$, for example about 0.5 $hr^{-1}$ to about 5 $hr^{-1}$, e.g. about 1 $hr^{-1}$. By the term liquid hourly space velocity there is meant the volume of feed passing per hour through unit volume of the catalyst.

The liquid hydrocarbon feedstock may be, for example, selected from naphthas, kerosenes, middle distillates, vacuum gas oils, lube oil brightstocks, diesel fuels, atmospheric gas oils, light cycle oils, light fuel oils, and the like.

In order that the invention may be clearly understood and readily carried into effect a preferred process in accordance with the invention, and a modification thereof, will now be described, by way of example only, with reference to the accompanying diagrammatic drawings.

Figure 2:
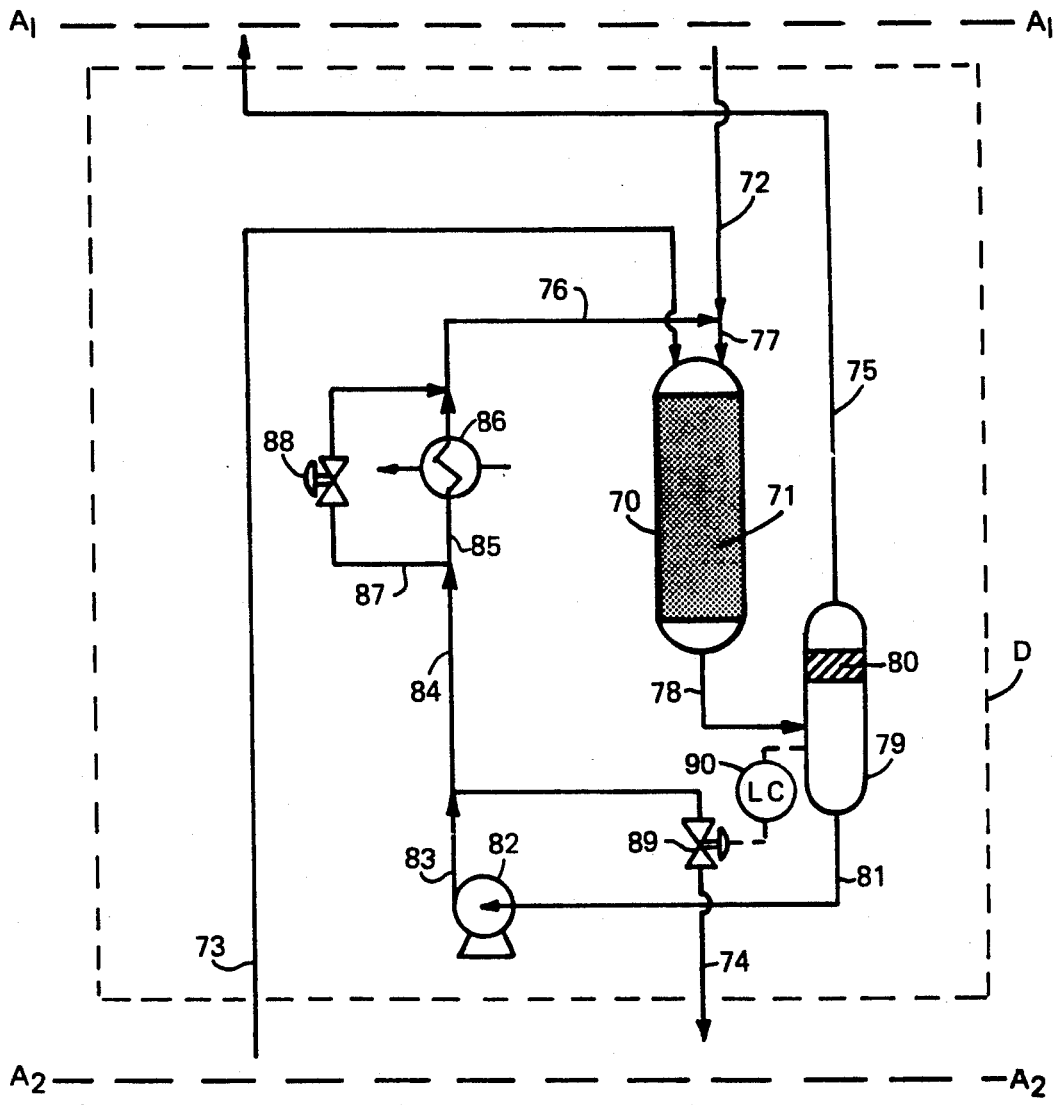
FIG. 2 is a flow diagram of an intermediate hydrodesulphurisation stage for incorporation into a multi-stage hydrodesulphurisation plant.

It will be appreciated by those skilled in the art that, as FIGS. 1 and 2 are diagrammatic, further items of equipment such as heaters, coolers, temperature sensors, temperature controllers, pressure sensors, pressure relief valves, control valves, level controllers, and the like, would additionally be required in a commercial plant. The provision of such ancillary items of equipment forms no part of the present invention and would be in accordance with conventional chemical engineering practice.

Referring to FIG. 1 of the drawings the illustrated plant is a two stage hydrodesulphurisation plant. For ease of description, the broken line A—A indicates the boundary between a first hydrodesulphurisation stage (the essential equipment for which is included within he box B indicated in broken lines) and a second hydrodesulphurisation stage (the essential equipment for which is depicted within the box C also drawn by means of broken lines).

Fresh preheated liquid feedstock to be treated in the hydrodesulphurisation plant flows in line 1 and is admixed with recycled liquid condensate in line 2 and with a recycled liquid stream in line 3. The mixed feed stream flows on in line 4 to first reactor 5 which is packed with a charge of catalyst 6. The liquid feed is distributed by means of a suitable liquid distributor device (not shown) substantially uniformly over the upper surface of the bed of catalyst 6. Desirably the catalyst is in the form of particles substantially all of which lie in the range of from about 0.5 mm to about 5 mm and the liquid is fed at a rate to maintain a superficial velocity down the bed of from about 1.5 cm/sec to about 5 cm/sec.

Typical reaction conditions include use of a pressure of about 90 bar and a feed temperature of about 270° C.

Hydrogen-containing gas from a subsequent reaction stage (e.g. stage C) is fed via line 7 to the entry side of reactor 5. The hydrogen:hydrocarbon feedstock molar feed ratio is preferably in the range of from about 3:1 to about 7:1. Gas and liquid proceed co-currently through catalyst bed 6 and exit reactor 5 in line 8 to pass into gas-liquid separation vessel 9. The separated gas phase passes through optional liquid droplet de-entrainer 10 and then travels on via line 11, condenser 12, and line 13 to a condensate separation vessel 14. A purge gas stream is taken from separation vessel 14 and passes via liquid den-entrainer 15, line 16 and flow control valve 17 to an $H_2S$ removal plant (not shown).

The liquid in condensate separation vessel 14 is withdrawn from vessel 14 in line 18 by pump 19 and circulated back to vessel 14 in line 20 through a flow restriction device 21 which ensures that the pressure in line 20 is higher than at any other point in the plant of FIG. 1. Recycle condensate re-enters vessel 13 in line 22.

Condensate in line 23 is also provided by the pump 19 in line 23 for distribution around the plant. This condensate in line 23 is recycled to reactor 5 via flow control valve 24 and line 2, whilst a controlled amount is fed through line 25 and a flow control valve 26 to line 27 which leads to the second hydrodesulphurisation stage C of the plant of FIG. 1.

Reference numeral 28 indicates a line by means of which a controlled amount of a solution of $H_2S$ in a suitable solvent, such as a hydrocarbon, or a controlled amount of an active sulphur-containing material, such as $CS_2$, COS, an alkyl mercaptan of formula RSH, a dialkyl sulphide of formula RSR, or a dialkyl desulphide of formula RS-SR, in which R is an alkyl group such as n-butyl, can be supplied, conveniently in solution form, as necessary to the hydrodesulphurisation plant as will be described further below.

The liquid phase from separation vessel 9 is withdrawn in line 29 by pump 30. Part of the liquid in line 31 flows on in lines 32 and 33 to heat exchanger 34 which is supplied with cooling medium in line 35 and which is provided with a bypass line 36 with a flow control valve 37. The resulting combined streams from line 38 and exiting heat exchanger 34 pass into line 3 for recycle to reactor 5. By varying the proportions flowing via heat exchanger 34 and via bypass line 36 the temperature of the liquid recycled to reactor 5 in line 3 can be appropriately controlled and can exert a corresponding influence on the temperature of the mixed feed in line 4 of reactor 5.

The balance of the liquid from line 31 passes on to the downstream desulphurisation stage C through flow control valve 38 and then by way of line 39 to join with the liquid in line 27 to form the feed to the second hydrodesulphurisation stage C. The liquid in line 27 provides a source of active sulphur-containing material by means of which the catalyst in hydrodesulphurisation zone C can be maintained in adequately sulphided form to obviate the danger of hydrocracking reactions occurring. Flow control valve 38 is itself controlled by level control signals from a level controller 40 which detects the liquid level in separation vessel 9.

The second hydrodesulphurisation stage C includes a second reactor 41 which contains a fixed bed 42 of a hydrodesulphurisation catalyst. The liquid feed to the second hydrodesulphurisation reactor 41 is formed by mingling the liquid streams from lines 27 and 39 with recycled liquid material from line 43 and is fed to reactor 41 in line 44. This is also supplied with fresh hydrogen-containing gas by way of line 45. The liquid and gas flow in co-current through the second reactor 41 and exit therefrom in line 46 to a gas-liquid separator 47. The gas passes through an optional droplet coalescer 48 into line 49 to form part of the hydrogen-containing gas in line 7.

Liquid that collects in separator 47 exits therefrom in line 51 under the control of valve 52 which is itself under the control of a level controller 53 that detects the liquid level in separator 47. It then passes through cooler 54, which is supplied with coolant in line 55, via line 56 to a further gas-liquid separation vessel 57. As the solubility of hydrogen decreases with decreasing temperature hydrogen is evolved from the liquid phase in passage through cooler 54. The evolved hydrogen passes through optional droplet coalescer 58 into line 59 and joins with the gas in line 49 to form the mixed gas stream in line 7. The final liquid product exits the plant from separation vessel 57 in line 60 under the control of valve 61 which is itself under the control of level controller 62.

Part of the liquid from line 50 is recycled to the inlet end of reactor 41 in line 63 by pump 64 and flows on in lines 65 and 66 to a heater 67 which has a bypass line 68, flow through which is controlled by a valve 69. By varying the proportions flowing in lines 66 and 68 the temperature of the resultant liquid flow in line 43 can be controlled to an appropriate value.

The valve 26 can be controlled by means of a flow controller (not shown) in line 27. Valve 37 can be controlled by a temperature controller (not shown) that responds to the temperature in line 4, whilst valve 69 can be similarly controller by a corresponding temperature controller (not shown) responding to temperature changes in the material in line 44.

If desired, part or all of the hydrogen containing gas recovered from hydrodesulphurisation stage C can be passed through an $H_2S$ removal plant, which uses, for example, an amine wash process, prior to return to hydrodesulphurisation stage B.

The plant of FIG. 1 has two hydrodesulphurisation stages B and C which are depicted as being separated by the line A—A. However, the invention is not limited to use of only two hydrodesulphurisation stages; further intermediate stages can be included in the plant of FIG. 1 between stages B and C at the position of the line A—A. The flow sheet of such an intermediate hydrodesulphurisation stage D is depicted in FIG. 2.

Referring to FIG. 2 an intermediate hydrodesulphurisation stage D includes an intermediate hydrodesulphurisation reactor 70 containing a charge 71 of a hydrodesulphurisation catalyst. Reactor 70 is supplied in line 72 with liquid from an immediately preceding hydrodesulphurisation stage, such as stage B of FIG. 1 (in which case line 27 would be connected to line 72 at line A—A of FIG. 1), and with hydrogen-containing gas from the next succeeding stage in line 73, such as stage C of FIG. 1 (in which case line 7 would be connected to line 73 at the point where it crosses line A—A from stage C of FIG. 1). The treated liquid from stage D exists in line 74 and is connected to the next succeeding stage, such as stage C (in which case line 74 is connected to line 39 where this crosses line A—A to enter stage C), whilst hydrogen containing gas exits stage D in line 75 to provide the hydrogen for the preceding stage, such as stage B (in which case line 75 is connected to line 7 at line A—A where line 7 enters stage B in FIG. 1). Part or all of the hydrogen containing gas in line 75 can, if desired, be passed through an $H_2S$ removal plant which uses, for example, an amine wash process prior to passage to the preceding stage.

It will be readily apparent to the skilled reader that, although FIG. 2 has been described in relation to a three stage plant consisting of stages B, D and C connected in series, it is readily possible to construct a hydrodesulphurisation plant with four or more stages by connecting two or more stages D in series between stages B and C so as to give a series of stages BD . . . DC (where the dots indicate a possible further stage or stages D).

The greater the number of stages there are the closer is the approach to true countercurrent flow of liquid and gas in the plant. Depending on the nature of the feedstock and the temperature profile through the reaction stages of the plant and upon the relative volumetric flows of liquid and gas, the degree of desulphurisation in the latter stages of the reaction and the $H_2S$ level may allow for a subsequent stage or stages to be added, operating at essentially the same pressure as the rest of the hydrodesulphurisation plant, but aimed at aromatics saturation. In this case the fresh hydrogen-containing gas is fed to the aromatics hydrogenation stage or stages and then to the rest of the hydrodesulphurisation plant. It should also be noted that the liquid recycle through the final hydrodesulphurisation stage of the plant can with advantage be reduced or omitted, if very high levels of desulphurisation are desired.

Reverting to FIG. 2, the liquid stream in line 72 is combined with recycled liquid material from line 76 and fed in line 77 to reactor 71. Material exiting reactor 71 passes by way of line 78 to a gas-liquid separator 79 containing a droplet coalescer 80 and connected to line 75. Liquid collecting in separator 79 is withdrawn in line 81 by pump 82 and fed to line 83. Part of the liquid in line 83 passes on in line 84 to line 85 and heat exchanger 86 which has a bypass line 87 fitted with a control valve 88. Valve 88 enables control of the temperature of the liquid in line 76 and may be under the influence of a suitable temperature controller responding to the temperature in line 77. The rest of the liquid in line 83 is passed in line 74 to the next succeeding stage under the control of valve 89, which is in turn controlled by level controller 90 fitted to gas-liquid separator 79.

In operation of the plant the liquid feedstock supplied in line 1 passes in turn through the reactor 5, optionally through one or more reactors 70, and finally through reactor 41 before exiting the plant in line 60. In passage through the reactors the organic sulphur compounds are largely converted to $H_2S$ some of which exits the plant in line 60 dissolved in the liquid product. Separation of $H_2S$ from the liquid product can be effected in known manner, e.g. by stripping in a downstream processing unit (not shown).

The $H_2S$ content of the liquid phase fed to the final hydrodesulphurisation reactor 41 will normally contain sufficient $H_2S$ to ensure that the hydrodesulphurisation catalyst charge 42 remains adequately sulphided and so any risk of hydrocracking reactions occurring in final reactor 41 is minimised. In the preceding reactor or reactors, i.e. reactor 5 and optionally in reactor or reactors 70, the gas feed comes from a succeeding hydrodesulphurisation stage and so will contain $H_2S$ from contact with the liquid phase in that succeeding stage. Hence there will normally be sufficient $H_2S$ present at the inlet end of each reactor 5, 70 or 41 to ensure that its catalyst charge 6, 71, or 42 is adequately sulphided. If, however, for any reason the $H_2S$ level at the inlet to the first reactor 5 should fall below a safe level, then a suitable amount of a sulphur-containing material, preferably an active sulphur-containing material such as $CS_2$, COS, a mercaptan (e.g. n-butyl mercaptan), a dialkyl sulphide (such as di-n-butyl sulphide), or a dialkyl disulphide (e.g. di-n-butyl disulphide), is supplied, conveniently as a solution in a hydrocarbon solvent, in line 28 in order to boost the sulphur content of the feed to the inlet of reactor 5. As active sulphur-containing materials, such as $CS_2$, COS, alkyl mercaptans, dialkyl sulphides, and dialkyl disulphides, are readily and rapidly converted to $H_2S$, it can be ensured that the catalyst charge 6 in reactor 5 remains adequately sulphided so as to remove essentially all risk of hydrocracking occurring in reactor 5. Accordingly, in practising the invention, the sulphur content of the liquid feedstock in line 1 and that of the gas in line 7 are carefully monitored, using suitable monitors (not shown), to check that the $H_2S$ partial pressure at the inlet to reactor 5 remains above a predetermined minimum value sufficient to maintain the catalyst charge 6 adequately sulphided; if this $H_2S$ level should, for any reason, fall below this minimum safe level, then an appropriate amount of $H_2S$ or of $CS_2$, COS, an alkyl mercaptan, a dialkyl sulphide, a dialkyl disulphide or a similarly readily converted sulphur-containing compound is supplied in the from of a solution in line 28 to raise the $H_2S$ level to the required value. The inlet sulphur levels to the subsequent stage or stages can be monitored in similar manner and further active sulphur-containing material can be added as necessary so as to maintain the catalyst in each zone safely sulphided.

The invention is further illustrated in the following Examples.

EXAMPLES 1 to 6

Figure 3:
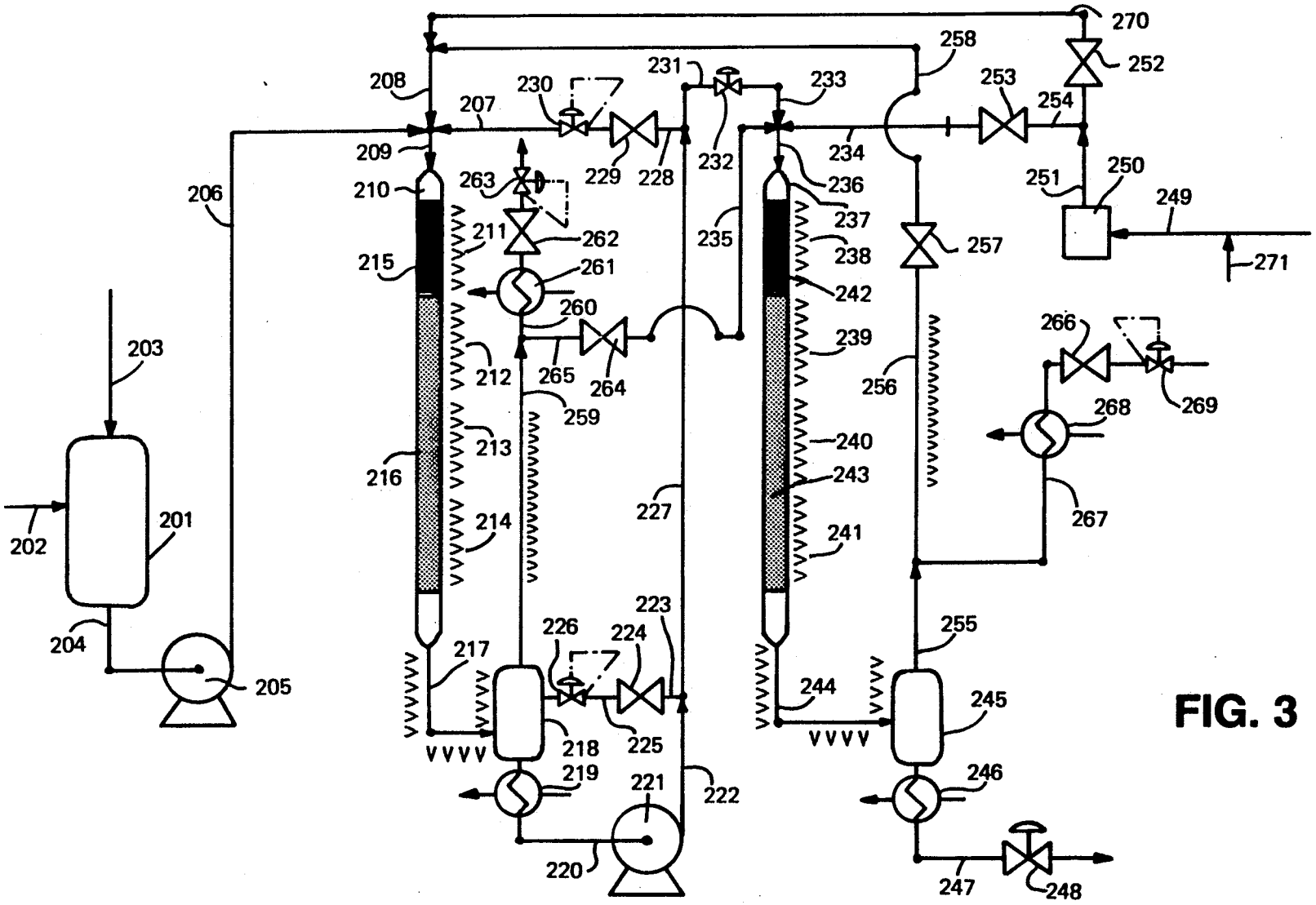
FIG. 3 is a flow diagram of a pilot plant used in conducting Comparative Example A.

The hydrodesulphurisation of a heavy vacuum gas oil is studied in the pilot plant apparatus shown in FIG. 3.

The gas oil to be treated is charged to a reservoir 201 via line 202. Reservoir 201 is then purged with an inert gas, such as nitrogen, by means of line 202 and line 203. Liquid from reservoir 201 passes by way of line 204, metering pump 205 and line 206 to join an optional liquid recycle in line 207 and a flow of hydrogen-containing gas from line 208. The combined gas and liquid flows pass on via line 209 to reactor 210.

Reactor 210 consists of a 25 mm internal diameter vertical tube 2 meters long with an axial thermocouple pocket (not shown). It is heated by four individually and automatically controlled electric heaters 211 to 214, each arranged to heat a respective zone of reactor 210. Reactor 210 contains two beds of particulate material 215 and 216. The lower bed 216 consists of an active sulphided $CoO_3$-$MoO_3$/gamma-$Al_2O_3$ hydrodesulphurisation catalyst, in the form of 1.6 mm diameter extrudates that are 2 to 4 mm long. Bed 216 is 1.4 meters deep. The upper bed 215 consists of a 0.5 meter deep packing of 1 to 1.5 mm diameter glass spheres. Bed 215 serves as a preheating section. During operation of the equipment under steady flow conditions axial temperature scans show that a deviation of less than +/−3° C. from the desired temperature can be obtained through the catalyst bed 216.

The liquid and gas pass through reactor 210 and exit through electrically heated line 217 into vessel 218, which is also electrically heated. The liquid phase then flows through cooler 219 and line 220 to pump 221. All or part of the liquid in line 222 can be recycled to vessel 218 via line 223, valve 224, line 225 and back pressure controller 226 to vessel 218. Any liquid not recycled via line 223 passes from line 222 on to line 227. All or part of the liquid in line 227 can be recycled back to the inlet of reactor 210 by way of line 228, valve 229, back pressure controller 230, and line 207. Any liquid from line 227 that is not recycled in line 228 flows on in line 231 through valve 232 to line 233. Valve 232 is operated by a level sensor (not shown) on vessel 218.

The liquid in line 233 is mixed with hydrogen-containing gas from line 234 or from line 235, depending upon the desired gas path through the pilot plant. The resulting mixed gas and liquid flows continue on in line 236 to a second reactor 237. This is essentially identical to reactor 210. Thus it is heated by four individually and automatically controlled electric heaters 238, 239, 240 and 241 and contains an upper bed 242 of glass spheres and a lower bed 243 of the same hydrodesulphurisation catalyst that is used in reactor 210. The liquid and gas from line 236 pass through reactor 237 and exit in line 244, which is electrically heated, and pass on to an electrically heated vessel 245. Liquid is discharged from vessel 245 through cooler 246 in line 247 under the control of valve 248 which is operated by means of a signal from a liquid level sensor (not shown) on vessel 245.

Hydrogen is supplied to the pilot plant from cylinders in line 249. The flow of pressurised hydrogen to the pilot plant is regulated by mass flow controller 250 and passes on in line 251. If valve 252 is closed and valve 253 is open the hydrogen from mass flow controller 250 passes by way of line 254 through valve 253 to line 234. The two phase mixture exiting reactor 237 passes via line 244 to vessel 245. The gas phase consists of hydrogen, inert gases and some hydrogen sulphide. Assuming that valve 252 is closed, then this gas phase passes on in line 255 to electrically heated line 256, through valve 257 to line 258 and hence provides the gas feed to reactor 210 in line 208.

From the bottom of reactor 210 there emerges in line 217 a two phase fluid which passes on to vessel 218. Again, assuming that valve 252 is closed, the gas phase separates in vessel 218 and passes via line 259 and line 260 to a cooler 261 and thence through valve 262 and pressure control valve 263 to a discharge line. Discharge line contains flow measurement and analytical equipment (not shown) and is vented to the atmosphere.

If valve 252 is closed then valve 264 in line 265 is also closed. Similarly valve 266 in line 267 is also closed when valve 252 is closed; line 267 also contains a cooler 268 and a pressure control valve 269.

In Example 1 valve 229 is closed so that liquid is not recycled from vessel 218 to the inlet of reactor 210. However, in Examples 2 to 6 valve 229 is open so that liquid recycle from vessel 218 to the inlet of reactor 210 occurs.

It will thus be seen that in Examples 1 to 6 the fresh incoming hydrogen passes first through reactor 237 and then the resulting $H_2S$-laden has recovered therefrom passes by way of lines 255, 256 and 258 to form the gas feed to reactor 210.

The characteristics of the heavy gas vacuum oil feedstock used in Examples 1 to 6 (and also in Comparative Example A) are set out in Table 1 below.

TABLE 1

| | |
|---|---|
| Type | Heavy vacuum gas oil |
| Boiling range (°C. at 1 ata) | 284 (initial) |
| | 432 (50% distilled) |
| | 559 (95% distilled) |
| Average molecular weight | 365 |
| Density (kg/m$^3$) | 944 |
| Sulphur content (% w/w) | 2.23 |
| Nitrogen content (ppm) w/w) | 3450 |
| Aromatics (volume %) | 27.7 |

The operating condition used in Examples 1 to 6 (and also in Comparative Example A) are set out in Table 2 below.

TABLE 2

| | |
|---|---|
| Pressure (kPa) | 8825 |
| Temperature (°C.) | 367 |
| Liquid feed rate (ml/hr) | 515 |

The results obtained in Examples 1 to 6 are set out below in Table 3, together with the results of Comparative Example A, a description of which appears below.

TABLE 3

| Example No. | $H_2$ flow rate (Nl/hr) | Liquid recycle rate (l/hr) | Product Analysis Line 222 S ppm | Line 222 N ppm | Line 222 Arom vol % | Line 247 S ppm | Line 247 N ppm | Line 247 Arom vol % |
|---|---|---|---|---|---|---|---|---|
| A | 282 | nil | 714 | 1829 | 22.0 | 134 | 973 | 17.6 |
| 1 | 298 | nil | 714 | 1815 | 22.0 | 33 | 932 | 17.4 |
| 2 | 298 | 1 | 714 | 1542 | 20.1 | 31 | 790 | 15.9 |
| 3 | 298 | 3 | 1182 | 1646 | 20.2 | 45 | 849 | 16.1 |
| 4 | 298 | 7 | 1606 | 1735 | 20.7 | 45 | 890 | 16.3 |
| 5 | 119 | 7 | 2520 | 1808 | 20.9 | 223 | 942 | 16.6 |
| 6 | 164 | 7 | 2119 | 1773 | 20.8 | 129 | 914 | 16.5 |

In Table 3 the sulphur and nitrogen contents are expressed as ppm by weight, whereas the aromatics content is expressed as percentage by volume.

COMPARATIVE EXAMPLE A

In this Comparative Example the pilot plant apparatus of FIG. 3 is also used. However, in this case valve 253 is closed, whilst valve 252 is open. Valve 229 is also closed. Valve 264 is open, as also is valve 266, whilst valves 257 and 262 are closed. In this way fresh hydrogen is supplied to the inlet end of reactor 210, whilst the gas emerging therefrom is passed by way of lines 259, 265, 235 and 236 to the inlet end of reactor 237. It will be seen by comparison of the results for Comparative Example A and those for Examples 1 to 6 set out in Table 3 that the efficiency of hydrodesulphurisation is significantly improved by adopting the teachings of the present invention.

Reference numeral 271 indicates a line by means of which a minor amount of a sulphurous material, e.g. $CS_2$ or $H_2S$, can be bled into the hydrogen stream in line 249 in order to ensure adequate sulphidation of the catalyst in reactors 210 and 237.

Examination of the results for the product analysis in line 247 given in Table 3 indicates that the removal of aromatics is better in Examples 1 to 6 than in Comparative Example A. In addition it can be seen from Table 3 that recycle of liquid around reactor 210 allows a significant reduction in the gas flow rate through reactor 210 to be made before the sulphur content of the product in line 247 rises above that of Comparative Example A. Even when the hydrogen flow rate is cut back so far that the extent of hydrodesulphurisation is less than in Comparative Example A, as exemplified in Example 5, the extent of nitrogen removal and of aromatics removal is enhanced in comparison to Comparative Example A. Comparison of the analysis figures for the product in line 247 for Examples 1 to 4 with those for Comparative Example A indicates that the choice of flow path for the hydrogen in Examples 1 to 4, in combination with the use of liquid recycle around reactor 210, enhances the performance of the catalyst in the second reactor 237. Thus although the sulphur content of the material in line 222 is the same in Example 2 (714 ppm) as that for Comparative Example A, yet the corresponding figures for the final product in line 247 are much better for Example 2 (31 ppm) than for Comparative Example A (134 ppm). In Examples 3, 4 and 6, although the sulphur content of the material in line 222 is higher than in Comparative Example A, yet the sulphur content of the product in line 247 is significantly lower, even though there is a much higher flow rate through reactor 210, and, in the case of Example 6, a large reduction in the hydrogen supply rate. In Example 5, although the hydrogen supply rate has been reduced so far that the sulphur content of the product in line 247 is higher than the corresponding value for Comparative Example A, yet the extent of nitrogen removal and of aromatics removal in the final product in line 247 is better than in Comparative Example A.

The hydrogenation of aromatic compounds in the presence of hydrodesulphurisation catalyst depends upon a number of factors, including thermodynamic and kinetic factors as well as the catalyst activity and its effectiveness.

From the point of view of thermodynamics the hydrogenation of an aromatic compound, e.g. an aromatic hydrocarbon, is an exothermic process. Moreover the extent to which the reaction will occur under particular conditions is limited by considerations such as the equilibrium at those conditions. In general the equilibrium is less favourable at high temperatures. Hence it is beneficial to operate at lower reaction temperatures, if possible.

The kinetics of the hydrogenation of aromatic hydrogenation reactions are favoured by use of high temperatures. Thus the rate of aromatics hydrogenation is increased strongly with increasing temperature, at a particular fixed hydrogen partial pressure, provided that the concentration of aromatics in the reaction mixture is above the equilibrium limit at the temperature concerned.

The capability of a given mass of catalyst of defined particle size range to perform aromatics hydrogenation is a function of the irrigation intensity applied to the catalyst particles, of the degree of sulphiding of the catalyst, and of the rates of mass transfer of $H_2$ and $H_2S$ to and away from the catalyst surface. Generally speaking, the best propensity for aromatics hydrogenation will be exhibited by a catalyst with a low degree of sulphidation which is exposed to a turbulent two phase (gas/liquid) mixed flow.

Figure 4:
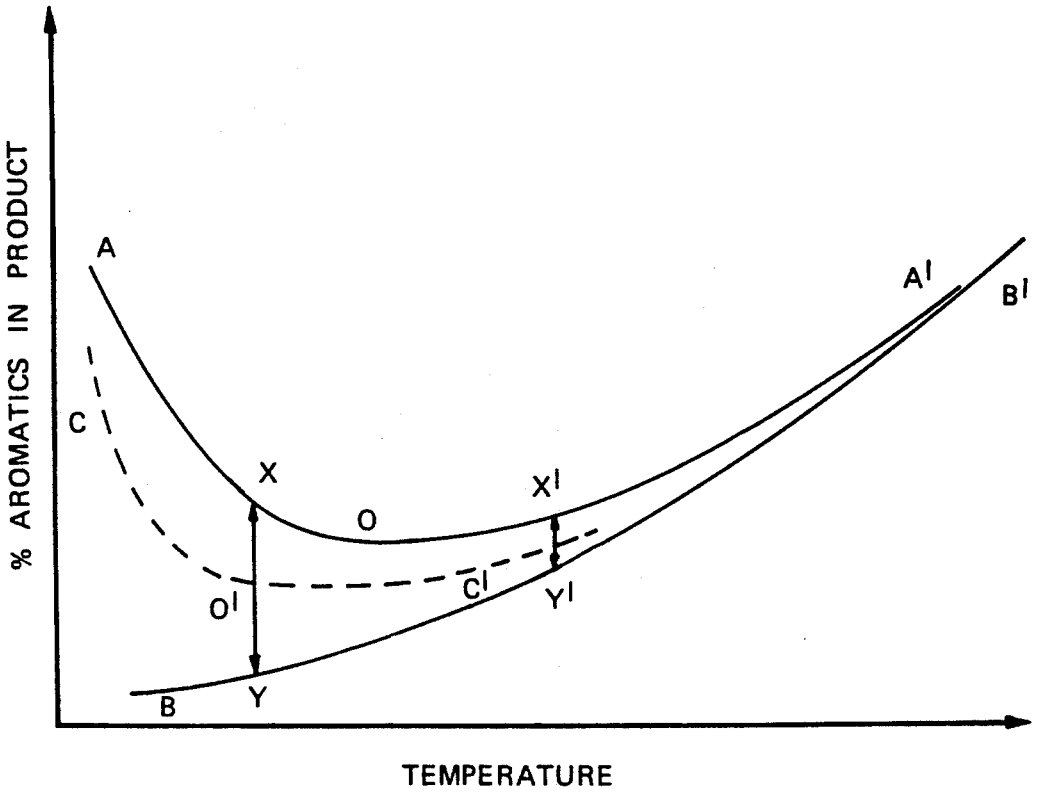
FIG. 4 is a graph showing the relationship between the aromatics content of the product and temperature of an aromatics hydrogenation reaction.

FIG. 4 is a graph indicating diagrammatically the effects of these various factors upon an aromatics hydrogenation reaction. In FIG. 4 there is plotted percentage aromatics in the product versus temperature for a given hydrogen partial pressure. Line A—A' in FIG. 4 indicates the variation with temperature, at a fixed hydrogen partial pressure, of the kinetically limited aromatics content of the product obtained from a given feedstock with a particular aromatics content using a fixed quantity of catalyst. Line B—B' represents the equilibrium limited aromatics content in the product form the same reaction system as a function of temperature. At any given temperature the line XY (or X'Y') represents the excess aromatics content of the product and hence provides a measure of the driving force required by the catalyst. The point O represents the lowest aromatics content obtainable form the given system and is obtainable only by selecting a combination of the most favourable kinetics and the less favourable equilibrium as the temperature increases.

If the activity of the catalyst can be enhanced in some way, e.g. by controlling the degree of sulphiding thereof, then a new curve such as C—C', can be obtained, with a new lower optimum aromatics level (point O') obtainable.

In practice crude oil derived feedstocks contain many different aromatic compounds and sulphur compounds, each with their own hydrogenation and hydrodesulphurisation kinetics. The prior removal of the less refractory materials, and the removal of the associated $H_2S$ from the sulphur compounds, that is possible using the teachings of the invention, makes it possible to achieve significant advantages using the process of the invention compared with conventional hydrodesulphurisation practices.

We claim:

1. A hydrodesulphurisation process for continuously effecting hydrodesulphurisation of a liquid sulphur-containing hydrocarbon feedstock which comprises:

(a) providing a plurality of hydrodesulphurisation zones connected in series each having an inlet end and an exit end and containing a packed bed of a solid sulphided hydrodesulphurisation catalyst, said plurality of hydrodesulphurisation zones including a first hydrodesulphurisation zone and at least one other hydrodesulphurisation zone including a final hydrodesulphurisation zone;

(b) maintaining hydrodesulphurisation temperature and pressure conditions in each hydrodesulphurisation zone effective for hydrodesulphurisation of the liquid feedstock;

(c) supplying liquid sulphur-containing hydrocarbon feedstock to the inlet end of the hydrodesulphurisation zone;

(d) passing the liquid feedstock through the plurality of hydrodesulphurisation zones in turn from the first hydrodesulphurisation zone to the final hydrodesulphurisation zone;

(e) passing hydrogen-containing gas through the hydrodesulphurisation zones from one zone to another;

(f) contacting the liquid feedstock with hydrogen under said hydrodesulphurisation temperature and pressure conditions in each hydrodesulphurisation zone in the presence of the respective charge of hydrodesulphurisation catalyst;

and which further comprises:

(i) recycling liquid material recovered from the exit and of the first hydrodesulphurisation zone to the inlet end of the first hydrodesulphurisation zone so as to provide diluent for admixture with the liquid feedstock;

(ii) supplying make up hydrogen to the inlet end of a hydrodesulphurisation zone other than the first hydrodesulphurisation zone;

(iii) recovering a hydrogen-containing gas from the exit end of each hydrodesulphurisation zone;

(iv) supplying the first hydrodesulphurisation zone with hydrogen-containing gas recovered from a subsequent hydrodesulphurisation zone;

(v) purging hydrogen-containing gas recovered from the exit end of the first hydrodesulphurisation zone;

(vi) if there are three or more zones supplying any other hydrodesulphurisation zone other than the first hydrodesulphurisation zone and other than the hydrodesulphurisation zone of step (ii) with hydrogen-containing gas recovered from another hydrodesulphurisation zone;

(vii) monitoring the sulphur content of the hydrogen-containing gas and of the mixture of diluent and liquid hydrocarbon feedstock supplied to the first hydrodesulphurisation zone; and (viii) supplying, when necessary, sulphur-containing material selected from $H_2S$ and active sulphur-containing materials to the first hydrodesulphurisation zone so as to maintain the catalyst charge thereof in sulphided form.

2. A process according to claim 1, in which the solid sulphided catalyst used is selected the group consisting of from molybdenum disulphide, tungsten sulphide, cobalt sulphide, sulphided nickel-molybdate catalysts ($NiMoS_x$), a sulphided $CoO$-$MoO_3$/gamma-$Al_2O_3$ catalyst, and mixtures thereof.

3. A process according to claim 1, in which the hydrodesulphurisation temperature and pressure conditions comprise a pressure in the range of from about 20 bar to about 150 bar and a temperature in the range of from about 240° C. to about 400° C.

4. A process according to claim 1, in which the hydrodesulphurisation temperature and conditions comprise a pressure in the range of from about 25 bar to about 100 bar and a temperature in the range of from about 250° C. to about 370° C.

5. A process according to claim 1, in which the temperature in the first hydrodesulphurisation zone is lower than in the second such zone, which in turn is lower than the temperature in any third such zone, and so on.

6. A process according to claim 1, in which the plant has two hydrodesulphurisation zones.

7. A process according to claim 6, in which the make-up hydrogen-containing gas is supplied to the final hydrodesulphurisation zone and the off-gas therefrom is then supplied to the first hydrodesulphurisation zone.

8. A process according to claim 1, in which the plant has more than two hydrodesulphurisation zones.

9. A process according to claim 8, in which the make-up hydrogen-containing gas is supplied to a second or subsequent hydrodesulphurisation zone.

10. A process according to claim 9, in which the make-up hydrogen-containing gas is supplied to the final hydrodesulphurisation zone and in which the off-gas therefrom is fed to the penultimate and subsequent zones.

11. A process according to claim 1, in which the material supplied to at least one hydrodesulphurisation zone subsequent to the first hydrodesulphurisation zone is diluted with a compatible diluent.

12. A process according to claim 11, in which the compatible diluent comprises liquid recovered from the exit end of the respective zone.

13. A process according to claim 1, in which the liquid feed to the final hydrodesulphurisation zone is not diluted with a compatible diluent.

14. A process according to any claim 1, which further includes the steps of:

(viii) monitoring the sulphur content of the hydrogen-containing gas and of the liquid hydrocarbon feedstock supplied to at least one hydrodesulphurisation zone subsequent to the first hydrodesulphurisation zone; and (ix) supplying, if necessary, sulphur-containing material selected from $H_2S$ and active sulphur-containing materials to that hydrodesulphurisation zone so as to maintain the catalyst charge thereof in sulphided form.

* * * * *

UNITED STATES PATENT AND TRADEMARK OFFICE

CERTIFICATE OF CORRECTION

PATENT NO. : 5,292,428

DATED : March 8, 1994

INVENTOR(S) : George E. Harrison, et. al.

It is certified that error appears in the above-indentified patent and that said Letters Patent is hereby corrected as shown below:

Column 3, in the third formula "$+^{H}2$" above the arrow should be -- $+5H_2$--;

Column 9, line 42, delete "0";--.

Column 21, line 43, after "selected" insert -- from --; Column 21, line 44, delete "from"; Col. 22, line 40, "(viii)" should be -- (ix) --;

Column 22, line 45, "(ix)" should be --(x) --.

Signed and Sealed this

Twentieth Day of September, 1994

Bruce Lehman

*Attest:*

BRUCE LEHMAN

*Attesting Officer*

*Commissioner of Patents and Trademarks*